United States Patent [19]

Levene et al.

[11] Patent Number: 4,672,870

[45] **Date of Patent: * Jun. 16, 1987**

[54] VACUUM DIE CUTTING APPARATUS FOR FOAM BACKED MATERIALS

[75] Inventors: Martin M. Levene; William W. Lessard, both of Kitchener, Canada

[73] Assignee: Ontario Die Company Limited, Waterloo, Canada

[ * ] Notice: The portion of the term of this patent subsequent to Oct. 1, 2002 has been disclaimed.

[21] Appl. No.: 690,159

[22] Filed: Jan. 10, 1985

Related U.S. Application Data

[63] Continuation-in-part of Ser. No. 657,747, Oct. 4, 1984, which is a continuation-in-part of Ser. No. 590,961, Mar. 19, 1984, Pat. No. 4,543,862.

[51] Int. Cl.[4] ..... B26D 7/02

[52] U.S. Cl. ..... 83/19; 83/29; 83/139; 83/176; 83/451; 269/21

[58] Field of Search ..... 83/29, 55, 139, 451, 83/176, 100, 19, 648, 694; 269/20–22; 137/526, 533.11

[56] References Cited

U.S. PATENT DOCUMENTS

| | | | |
|---|---|---|---|
| 231,997 | 9/1880 | Chamberlain | 137/526 |
| 599,227 | 2/1898 | Du Brul | 83/451 |
| 1,616,752 | 2/1927 | MacDonald | 83/451 |
| 2,217,060 | 10/1940 | Korsen | 83/55 |
| 3,294,392 | 12/1966 | Dunham | 83/451 |
| 3,765,289 | 10/1973 | Gerber et al. | 83/452 |
| 3,777,604 | 12/1973 | Gerber | 83/451 |
| 3,790,154 | 2/1974 | Gerber et al. | 83/451 |
| 3,815,221 | 6/1974 | Pearl | 29/559 |
| 3,905,408 | 9/1975 | Hale | 83/451 |
| 4,018,247 | 4/1977 | Carr | 137/533.11 |
| 4,096,775 | 6/1978 | Thomsen | 83/55 |
| 4,286,622 | 9/1981 | Ninomiya et al. | 137/516.29 |
| 4,312,254 | 1/1982 | Pearl | 83/451 |
| 4,543,862 | 10/1985 | Levene et al. | 83/19 |

*Primary Examiner*—Frank T. Yost
*Assistant Examiner*—Hien H. Phan
*Attorney, Agent, or Firm*—Krass & Young

[57] ABSTRACT

A stationary steel rule cutting die for cutting a fixed pattern in each of a plurality of stacked compressible material layers according to the shape of the rule die, including a vacuum system for vertically reducing the stack height of the compressible material layers without lateral distortion prior to cutting and retaining the compress condition during the progressive or incremental cutting operations.

19 Claims, 10 Drawing Figures

Fig-8
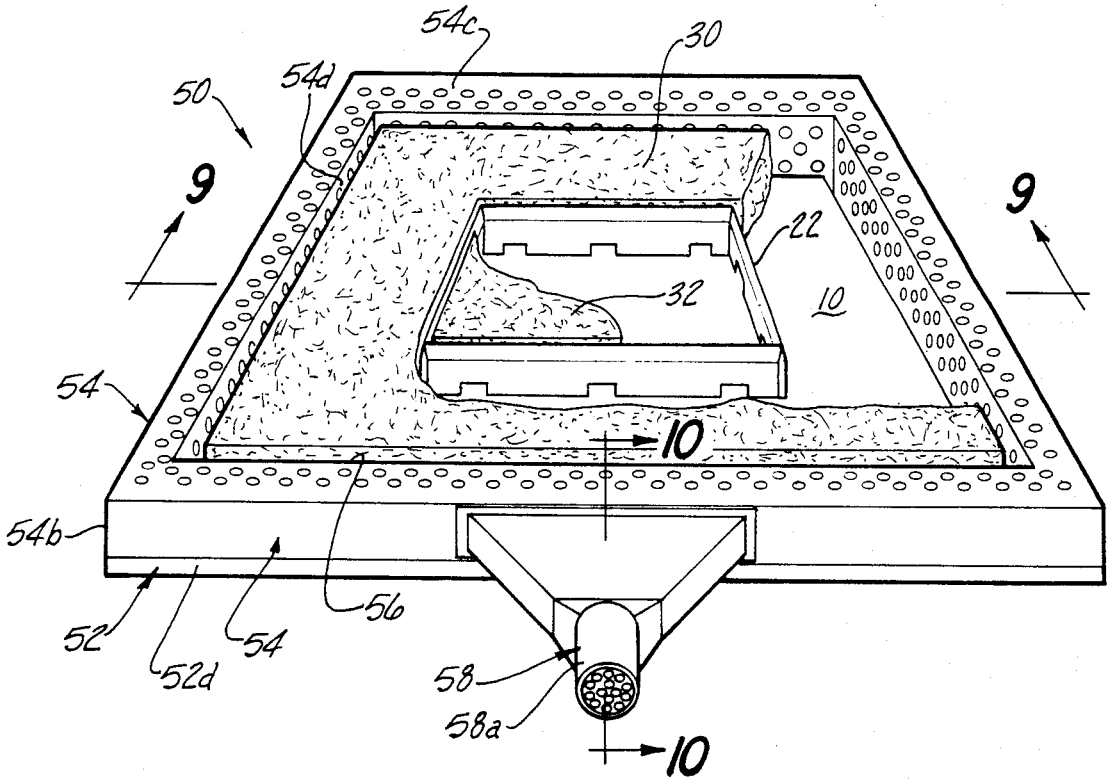
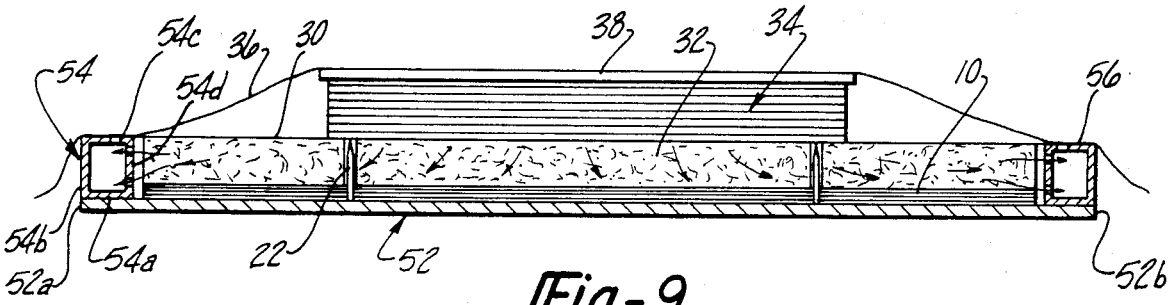
Fig-9
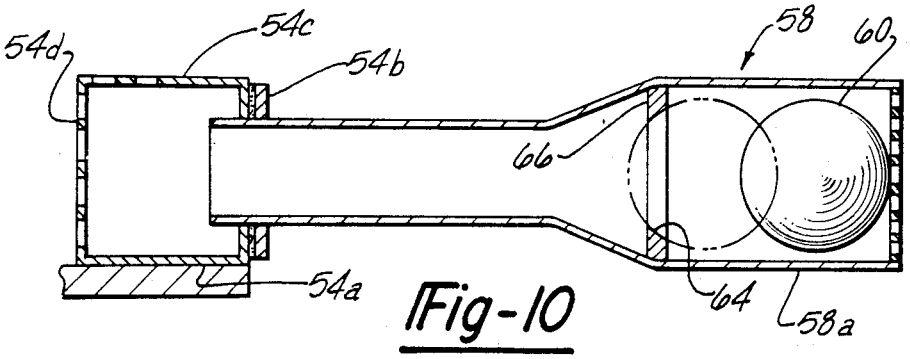
Fig-10

VACUUM DIE CUTTING APPARATUS FOR FOAM BACKED MATERIALS'

RELATED APPLICATION

This application is a continuation-in-part of U.S. patent application Ser. No. 657,747, filed Oct. 4, 1984 which in turn is a continuation-in-part of U.S. patent application Ser. No. 590,961, filed Mar. 19, 1984 and now U.S. Pat. No. 4,543,862.

BACKGROUND OF THE INVENTION

Steel rule dies are commonly used for cutting cloth and clothlike materials such as natural textiles, and synthetic materials such as vinyl. Steel rule dies are particularly advantageous in the repetitive cutting of specific shapes such as apparel, automobile upholstery and trim panels, and the like. In brief, a steel rule die typically comprises a base or backing board in which a slot or groove matching the pattern to be cut is sawn, and a length of steel rule embedded in the board with the sharpened exposed upper edge extending therefrom. The die is used in combination with a cutting pad and a press which may either be single-cut, progressive, or increment feed.

A problem arises when it is necessary or desirable to cut relatively thick but compressible materials such as foam-backed materials, foam rubber, waddings, battings, paddings, high pile materials, and other fluffy or spongy materials. A stack or a particularly thick single layer of such materials is sufficiently unstable that an accurate cut is often not possible using conventional techniques.

One approach to the more accurate cutting of compressible materials is disclosed in U.S. Pat. Nos. 3,790,154, 3,765,289, and 3,815,221, all assigned to Gerber Garment Technology, Inc. of East Hartford, Conn. These patents, and other related patents assigned to Gerber, disclose a vacuum table which is used primarily to hold sheet material in place while it is cut by a two-axis single blade jigsaw type cutter. According to these patents, a sheet of Mylar or other air impervious material can be placed over a stack of compressible materials such that the vacuum table creates a vacuum under the sheet to pull downwardly on the sheet and maintain the entire stack in a stable, compressed condition during the cutting process In a further Gerber U.S. Pat. No. 4,060,016, the jigsaw type cutter is replaced by a rotatable turret carrying a plurality of blanking dies which are selectively rotated into position and driven downwardly through an air impervious sheet and through the stacked materials to form a stack of cut patterns corresponding to the shape of the particular die selected. In all of the patented systems the board on which the stacked material is located must be capable of receiving the penetrations of the reciprocating knife as well as maintaining a vacuum for the principal purpose of holding the stack in place and for the secondary purpose of evacuating the volume under the air impervious sheet.

All of these patented arrangements also suffer from the disadvantage that the air impervious sheet is cut in the process of cutting the stacked material layers with consequent loss of vacuum and thereby a loss of stability of the stack. And whereas certain of the Gerber patents described means for "healing" the cut in the air impervious sheet behind the cutting member, these healing arrangements unduly complicate the overall cutting apparatus and/or are not totally successful in preventing loss of vacuum with a consequent loss of stability of the stack.

BRIEF SUMMARY OF THE INVENTION

The present invention is directed toward the design and use of stationary steel rule cutting dies with air-evacuation compression techniques so as to facilitate and improve the use of such dies to cut compressible materials.

According to a basic feature of the invention, a cutting edge and compressible material to be cut by the cutting edge are placed in a sealed, collapsible chamber; air is evacuated from the chamber to collapse the chamber and compress the compressible material against the cutting edge; and the cutting edge is moved through the compressed material to cut a fixed pattern in the material corresponding to the shape of the cutting edge. Since the cut occurs from within the sealed chamber, the integrity of the chamber is not destroyed in the cutting operation.

According to a further feature of the invention, the cutting edge is defined by a steel rule die including a base and a steel rule upstanding from the base; the compressible material is placed on the sharpened upper edge of the steel rule; and the sealed, collapsible chamber is defined by an air impervious cover sheet placed over the compressible material and over the base of the steel rule die so that, when air is evacuated from beneath the sheet, the sheet is pulled downwardly to compress the material against the sharpened upper edge of the steel rule.

It is to be understood that the die of the subject invention is used in combination with a press of either the single stroke or progressive or incremental feed type. In the typical arrangement the base containing the steel rule is placed on a horizontal support surface with the sharpened upper edge of the rule facing upwardly, the materials are stacked on top of the rule and the press is oriented over the die so as to push the stack of materials against the sharpened upper edge of the rule to perform the cutting action.

In the preferred form, a pad or board of rigid but relatively soft material is placed over the stack of material to be cut so that the steel rule cutting edge works against and actually penetrates slightly into the baord and the board functions to maintain the vacuum condition even in the event of damage to the air impervious sheet. In accordance with the invention, the board can be placed either over or under the air-impervious sheet. Where ease of handling is the overriding consideration, the board may be placed over the air impervious sheet. However, in most situations it is preferably to place the board under the sheet since this eliminates periodic replacement of the sheet and, very importantly, precludes horizontal compression of the stacked material during the cutting operation and thereby significantly improves the accuracy of the cut and the resulting dimensional uniformity of the cut pieces.

Where the steel rule forms a closed figure and the vacuum source is external of the die it is sometimes necessary to vent the interior of the closed figure defined by the steel rule to the external area of the die. In the preferred form the steel rule is formed with regular-occuring gaps in the unsharpened side of the rule so as to provide vents to equalize pressure as between the inside and outside of any closed figure formed by the rule.

Compressible members are provided on the base adjacent to the rule for supporting the compressible material layers substantially level with the upper cutting edge of the rule. The compressible members are open celled to act as a conduit to facilitate evacuation of the vacuum chamber, and compress in response to downward movement of the upper platen to allow the cutting edge of the rule to move through the layers of stacked materials.

In one disclosed embodiment of the invention, a groove is formed in the base adjacent but outside of the rule, the groove is connected to suitable vacuum pump means, and open celled compressible members are positioned between the groove and the outer perimeter of the rule.

In another disclosed embodiment, an upstanding collar member extends around the outside of the groove and a rigid perforate plate covers the groove with an open celled compressible member positioned between the collar and the rule and overlying the perforate plate.

In a further embodiment of the invention, the base of the steel rule die is supported on a die carrier and the die carrier includes means which are operative to exhaust air from a vacuum chamber formed beneath the air-impervious cover to compress and reduce the thickness of the stacked materials prior to the cutting operation. The die carrier defines a suitable vacuum surface and the steel rule die defines a vacuum surface generally conforming in size and shape to the vacuum surface on the die carrier so that the steel rule die may be positioned on the die carrier with the vacuum surface on the steel rule die intimately juxtaposed to the carrier vacuum surface to allow evacuation of the vacuum chamber. This arrangement obviates the need for a vacuum device as a part of each steel rule die.

According to a further aspect of the invention, the die includes a conduit for communicating the vacuum chamber with a suitable vacuum pump means and a check valve is provided in the conduit which functions upon disconnection of the conduit from the vacuum pump means to maintain the vacuum condition in the vacuum chamber. With this arrangement, the vacuum hoses connecting the die with the vacuum pump may be disconnected from the vaccum after a vacuum has been achieved so that the vacuum hoses need not accompany the die in its movement through the press. This arrangement is particularly desirable when a die is being moved through a progressive press involving a plurality of progressive cutting stations.

BRIEF DESCRIPTION OF THE DRAWINGS

FIG. 8 is an exploded perspective view of a further modified steel rule die cutting arrangement according to the invention;

FIG. 9 is a cross sectional view taken on line 9—9 of FIG. 8; and

FIG. 10 is a cross sectional view taken on line 10—10 of FIG. 8.

DETAILED DESCRIPTION OF THE SPECIFIC EMBODIMENT

Figure 1:
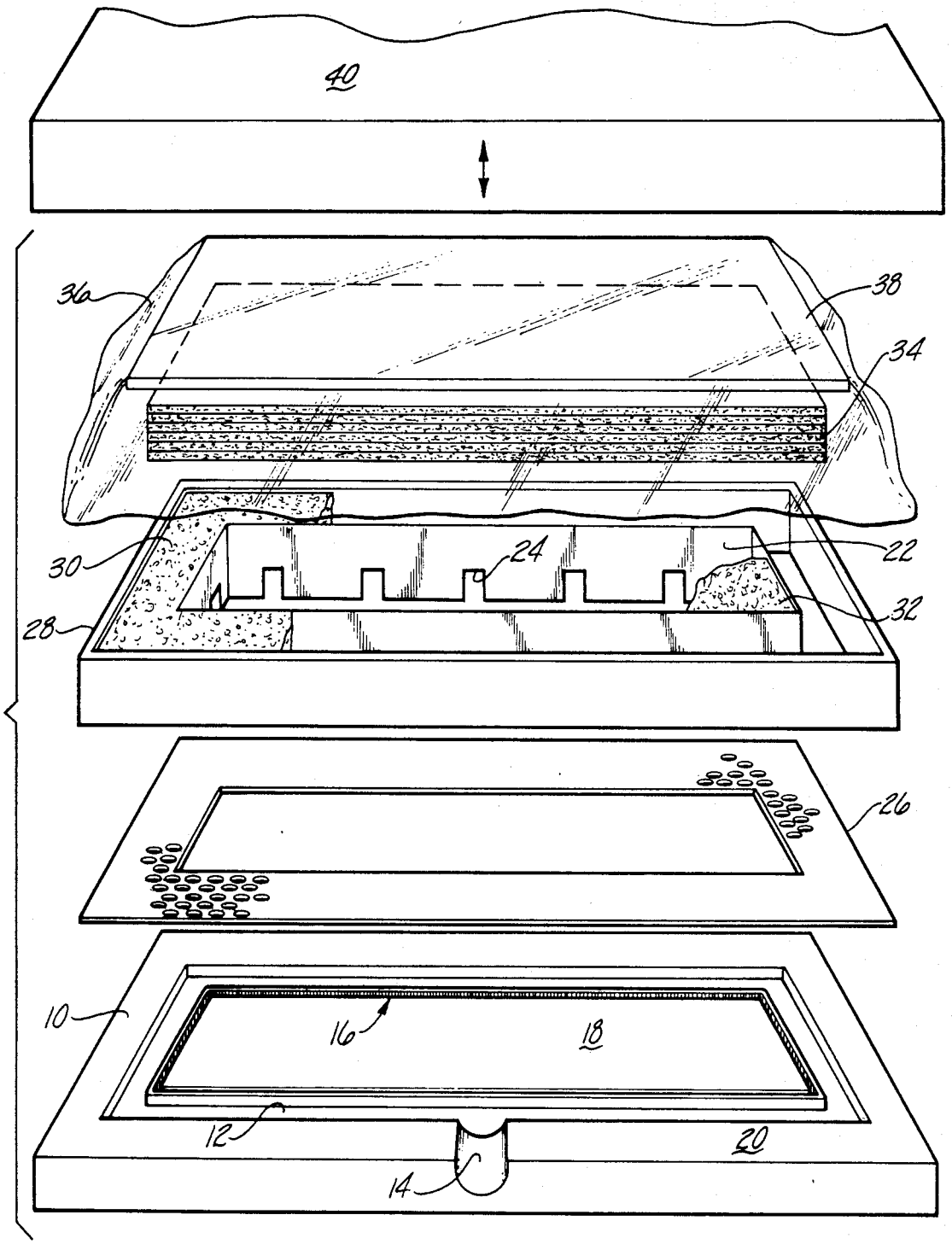
FIG. 1 is an exploded, perspective view of a steel rule die cutting arrangement according to the invention.

Referring to the drawings, the invention embodied in the apparatus of FIGS. 1–5 comprises a base 10 of thick plywood board having a wide rectangular groove 12 formed in the upper surface thereof and communicating with a cylindrical channel 14 which extends to the outer edge of the base board 10. The upper surface also has sawn therein an inner slot 16 defining major co-planar surfaces 18 and 20.

A strip of steel rule 22 is formed into a shape congruent with the slot 16 and in the present invention is specially formed to exhibit slots 24 in the bottom or blunt edge thereof for purposes to be described. The steel rule 22 is sharp and, in some cases, serrated along the upper exposed edge and is driven into the slot 16 of the plywood base 10. In the present instance rule 22 forms a closed figure. Accordingly, the slots 24 are formed in the bottom or blunt end of the rule with a height exceeding the extent to which the rule is driven into the board 10 so as to provide air communication passages between the interior of the figure formed by the rule 22 and the volume represented by the slot 12 in board 10.

Figure 2:
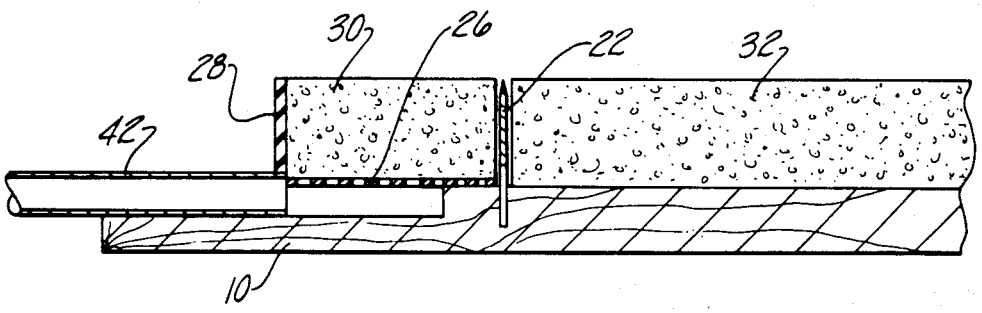
FIG. 2 is a section through part of the apparatus of FIG. 1 showing details thereof.

When rule 22 is in place in the board 10 a perforated plate 26 having a substantially quadrangular configuration is placed over the slot 12 and, as best shown in FIG. 2, extends substantially up to the exterior lateral surface of the rule 22.

In the illustrated embodiment a collar 28 of air tight material such as closed cell plastic or rubber is placed on the surface 20 of the board 10 and is filled in the volume between the collar 28 and the rule 22 with open cell foam 30. Similarly the interior of the figure formed by the rule 22 is filled with open cell foam 32 which rests on surface 18. The foam elements 30 and 32 essentially provide a compressible support surface for a stack 34 of compressible materials to be cut using the die shown in the drawing such that the materials do not have to rest directly on the exposed edge of the rule 22. The stack of 34 is then topped with a board 38 and, finally, covered by a thin, flexible, but air-tight, plastic shroud 36 defining an air-impervious cover or shroud which is preferably substantially larger than the die apparatus so as to be capable of extending beyond the lateral boundaries thereof and onto a flat support surface such as one might find in a typical workshop where flatbed die cutting operations are carried on. Board 38 must be substantially rigid but must have a surface that is soft enough to allow at least slight penetration by rule 22. Board 38 may, for example, comprise a sheet of polypropylene, nylon, vinyl, urethane or vinyl coated woven fabric material. Board 38 lies between the cutting edge of rule 22 and the sheet 36 to prevent cutting of the sheet and loss of vacuum during the press-cutting operation. Board 38 in effect becomes a part of the cover sheet and maintains the vacuum condition even in the event that the cover sheet is damaged. Board 38 also functions during the cutting operation to preclude horizontal compression of the stacked materials.

Figure 3:
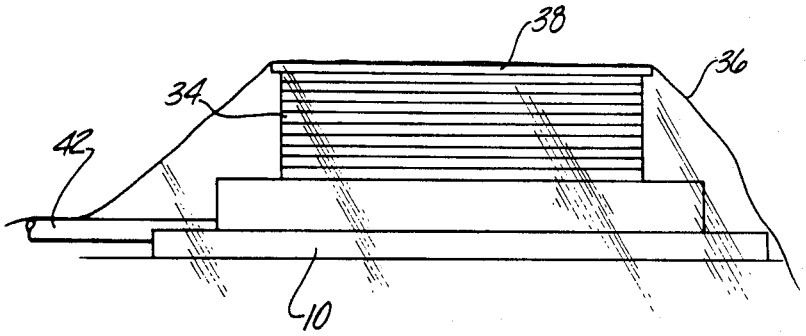
FIG. 3 is a side view of a stack of materials on a die before compression.
Figure 4:
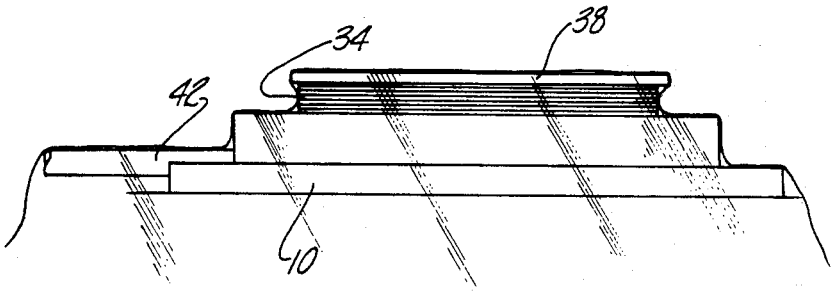
FIG. 4 is a side view of the same stack of materials after compression.

In operation, the assembled die comprising elements 10, 22, 26, 28, 30 and 32 is placed on a flatbed die cutting table and the stack 34 of compressible materials is placed in position over the sharp cutting edge of the rule 32. Board 38 is placed over the stack 34. Cover sheet 36 is placed over the assembly and pulled down tight against the surface of the table and a vacuum source is attached to fitting 42 which is placed in the channel 14 shown in FIG. 1. The original uncompressed condition is represented in FIG. 3 wherein the stack 34 may be on the order of five or six inches in vertical thickness. The "cutting-ready" condition is represented in FIG. 4 where sufficient air has been drawn out from under the cover sheet 36 to vertically reduce the height of the stack 34 down to about 1" or 1½" without any lateral or horizontal distortion. At this time the upper press platen 40 is operated to drive the stack 34 down over the blade or rule 22 compressing the plastic foam support materials 30 and 32 until all the layers of material in the stack 34 are cut. Board 38 serves not only as a surface that the steel rule cuts against but also serve as a seal so that air, which has been drawn out from under cover sheet 36, cannot re-enter the enclosed environment with a resultant loss of vacuum and loss of compression of the stacked materials.

Figure 5:
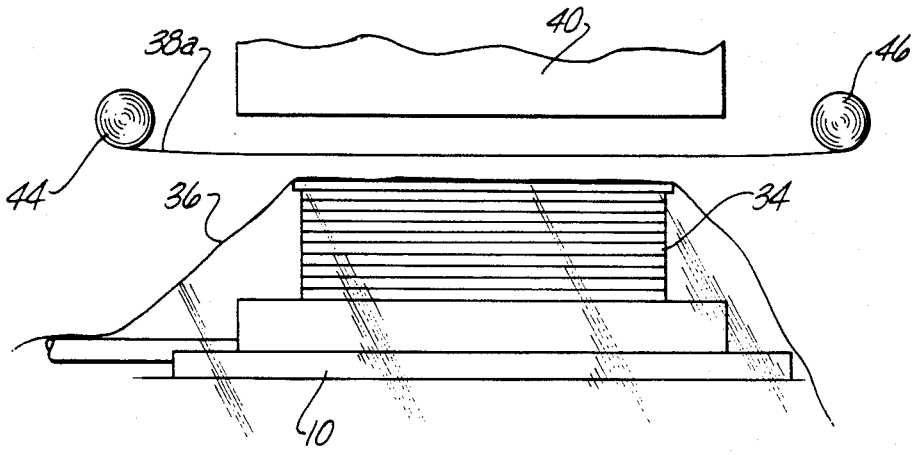
FIG. 5 is a side view of a stack on a die using a belt-type cutting pad.

FIG. 5 shows an alternative embodiment where the steel rule 22 cuts against a belt-type pad 38*a* which is made of woven synthetic material coated/impregnated with urethane or the like to form a tough, somewhat flexible pad. In this case, the pad 38*a* is outside of the shroud sheet 36 such that the sheet is cut by the rule 22 with each operation of press 40. However, this inconvenience is offset by the fact that handling of pad 38a is made easier by attachment to the press 40 and by advancement thereof between supply and take-up devices 44 and 46, respectively.

Figure 6:
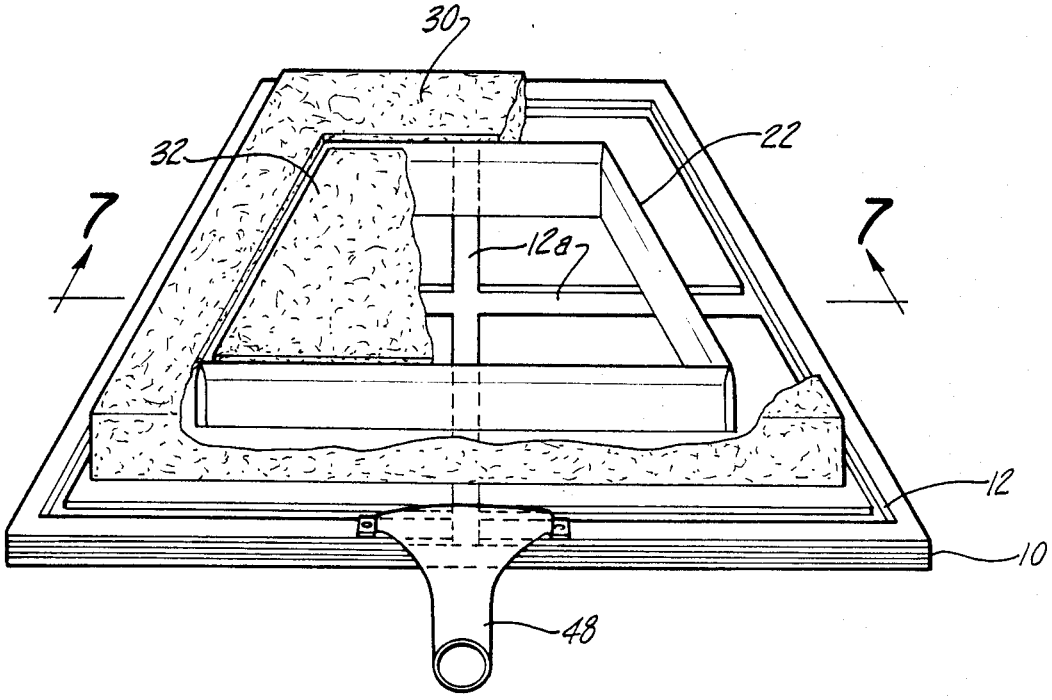
FIG. 6 is an exploded view of a modified steel rule die cutting arrangement according to the invention.
Figure 7:
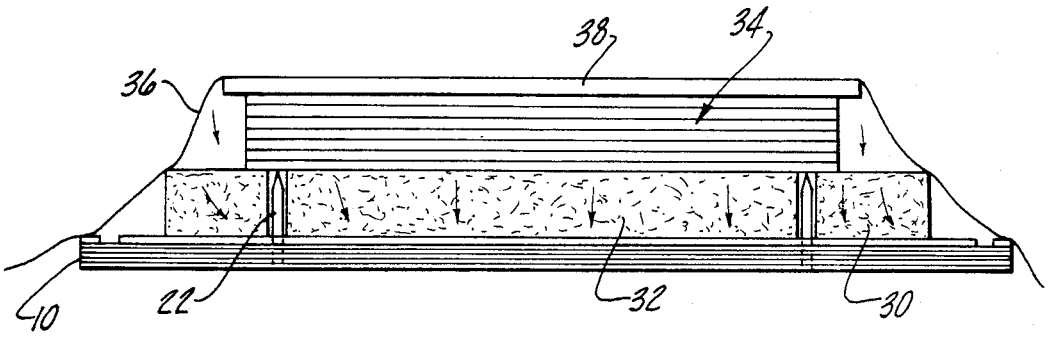
FIG. 7 is a cross sectional view taken on line 7—7 of FIG. 6.

In the modified steel rule die construction shown in FIGS. 6 and 7, identical reference numerals have been used to identify elements in the structure of FIGS. 6 and 7 that substantially correspond to elements in the FIGS. 1–5 embodiment. Thus an elongated rectangular plywood board 10 is formed with a wide rectangular groove 12, a steel rule 22 is driven into board 10 within groove 12, an open cell foam member 32 fills the interior of steel rule 22, and an open cell foam member 30 extends around the exterior of steel rule 22 within groove 12. Groove 12 in this embodiment includes portions 12*a* extending transversely and longitudinally beneath the steel rule to form a grid network within the exterior groove 12. In operation, the stack 34 of compressible material is placed in position over the sharp cutting edge of the rule 22, a board 38 is placed over the stack 34, a cover sheet 36 is placed over the assembly and pulled down tight against the edges of board 10 to form a vacuum chamber, and air is evacuated from the vacumm chamber through a suitable conduit 48 secured to an end edge of board 10 and communicating with groove 12. After the air has been drawn out of the vacuum chamber to compress and reduce the thickness of the stacked layers of material, the upper press platen (not shown) is operated to drive the stack 34 down over the rule 22, compressing the foam plastic support materials 30 and 32 until all of the layers of material in the stack 34 are cut. Note that this embodiment dispenses with the collar 28 and perforated plate 26 of the FIGS. 1–5 embodiment.

In the FIGS. 8 and 9 embodiment, the die assembly includes a die carrier forming a part of the feed system of the press in which the cutting operation is performed. The steel rule die in this embodiment includes a plywood board 10, a steel rule 22 mounted in board 10, an open cell foam member 32 filling the interior of rule 22, and an open cell foam member 30 positioned around the exterior of steel rule 22. The die carrier, seen generally at 50, includes a base plate 52 and a fence member 54 upstanding from and extending around the peripheral edge of base plate 52. Base plate 52 is in the form of an elongated rectangle with long side edges 52*a*, 52*b* and short end edges 52*c*, 52*d*. Fence member 54 comprises metal tubing of rectangular cross section extending in a closed loop around all four edges of base plate 52. Tubing 54 includes all inperforate bottom wall 54*a*, an imperforate outer wall 54*b*, a perforate top wall 54*c*, and a perforate inner wall 54*d* forms a vacuum channel Tubular fence 54 extends upwardly above the surface of plate 52 by a distance generally corresponding to the composite height of the steel rule die, and the interior area bounded by fence 54 generally corresponds in size and configuration to board 10 of the steel rule die.

In operation, the steel rule die is positioned on plate 52 within tubing 54 56 with the outer edge surfaces of open cell foam member 30 intimately juxtaposed to the respective perforate inner walls 54*d* of tubing 54. Stack 34 of compressible materials is placed in position over the sharp cutting edge of rule 22, board 38 is placed over stacked 34, cover sheet 36 is placed over the assembly and pulled down tight against the periphery of the die carrier to form a vacuum chamber, and air is evacuated from the vacuum chamber through a suitable tubular fitting 58 received in an opening in the outer wall 54*b* of tubular fence 54 along the end edge 52*d* of base plate 52. As in the previous embodiments, as the air is sucked out of the vacuum chamber beneath the cover, the height of stack 34 is significantly compressed and reduced whereafter the upper press platen (not shown) is operated to drive the stack 34 down over the blade or rule 22, compressing the plastic foam support materials 30 and 32 until all the layers of material in the stack have been cut. Board 38 functions during the evacuation and compression step to ensure that no significant horizontal compression takes place in the stack so that the finished cut parts are accurate and uniform when they return to their normal uncompressed state after being cut. The arrangement of FIGS. 8 and 9 obviates the need for a separate vacuum system in each steel rule die since the vacuum system is provided on the die carrier and the same die carrier may be used with a multitude of different steel rule dies.

FIG. 10 discloses a check valve to be used with any of the disclosed steel rule die cutting arrangements. For example, although the check valve is disclosed in conjunction with conduit 58 of the FIGS. 8 and 9 embodiment, the check valve could also be used with the fitting 48 of FIGS. 6 and 7 embodiment or with the conduit 42 of the FIGS. 1–5 embodiment. The check valve may take various forms. As disclosed, the check valve includes a lightweight hollow ball 60 coacting with a seat 64 formed in a portion 66 in an enlarged portion 58*a* of conduit 58. The free end of conduit 58 is adapted to receive a vacuum hose 68 which in turn is adapted to be connected to a suitable vacuum pump (not shown). In operation, the vacuum pump is operated to suck air out of the vacuum chamber beneath the cover with the ball 60 lifting off of seat 64 to allow the escape of air from the vacuum chamber. Once the vacuum has been achieved, the drive assembly is moved in the direction of the arrow in FIG. 8 into a press (not shown) which makes a series of successive hits or cuts on the stacked sheet as the die assembly is fed progressively into and through the press. As the end 52*d* of the die carrier approaches the press, the vacuum hose 68 is removed from conduit 58 as the vacuum hose is removed, ball 60 seats against seat 64 under the urging of the differential pressure acting on the ball to maintain the established vacuum condition in the vacuum chamber as the die assembly continues its movement through the press. This arrangement avoids the necessity of having the vacuum hose move through the press and thereby greatly simplifies the overall cutting operation.

It is to be understood that various modifications and additions to the structures shown are possible; for example, where the figure defined by the rule 22 is not closed, it is possible to eliminate the slots 24 which provide air communication between the inside and outside of the figure. Another convenience is the use of a spring-biased reel for the vacuum supply fitting 42 so that vacuum hose may be paid out and rereeled as the die is moved along a press pad. For a definition of the invention reference should be had to the appended claims.

We claim:

1. In a method of cutting compressible materials with a stationary steel rule cutting die wherein one or more layers of the materials are placed over the sharpened edge of a steel rule cutting die, the layers and die are covered with an air-impervious cover sheet and a backing pad, the volume covered by the cover sheet is evacuated, and the layers are pressed on to the die to cut the layers against the backing pad, the improvement wherein:

(A) said pressing step is performed in a stationary press;

(B) said evacuating step is performed by the use of a vacuum hose attached to the die prior to movement of the die and layers into the press;

(C) the vacuum hose is removed from the die prior to completion of the movement of the die and layers through the press; and (D) means are provided to maintain the vacuum condition upon removal of the vacuum hose so that the movement of the die and layers through the press may be completed with the vacuum condition intact but with the vacuum hose removed.

2. A method of cutting compressible materials comprising:

(A) providing an upwardly facing cutting edge;

(B) positioning a layer of compressible material over said cutting edge;

(C) defining a sealed, vertically collapsible chamber, totally enclosing said edge and said layer of compressible material positioned over said edge;

(D) evacuating air from said chamber to vertically collapse said chamber to an extent to vertically compress said layer of material and substantially reduce its vertical thickness and to press said compressed, reduced thickness layer of material downwardly against said edge; and (E) moving said cutting edge through said compressed, reduced thickness layer of material to cut a fixed pattern in the material corresponding to the shape of the cutting edge.

3. A steel rule die assembly for cutting a fixed pattern in each of a plurality of stacked compressible material layers according to the shape of the steel rule, said die assembly comprising:

(A) a die carrier defining a support surface;

(B) a steel rule die including (1) a base member adapted to be removably positioned on said support surface of said die carrier and (2) an upstanding steel rule fixed to said base member at its lower edge and having an exposed sharpened upper edge defining the fixed cutting pattern;

(C) air impervious cover means covering said die and said die carrier and any stacked layers of compressible material overlying siad upper rule edge and coacting with said die carrier to define a vacuum chamber delimited above by said cover means and below and laterally by said die carrier; and (D) means carried by said die carrier operative to exhaust air laterally outwardly from said vacuum chamber to compress and reduce the thickness of said stacked layers prior to cutting said layers with said rule.

4. A steel rule die assembly according to claim 3 and further including:

(E) a board placed over said stacked layers and under said cover means and operative to preclude horizontal compression of said stacked layers as said stacked layers undergo vertical compression in response to evacuation of said chamber.

5. A die assembly according to claim 3 wherein:

(E) said die carrier further defines a continuous peripheral vacuum surface; and (F) said die assembly further includes means defining a continuous vacuum surface generally conforming in size and shape to said die carrier vacuum surface and adapted to be intimately juxtaposed to said carrier vacuum surface with said base removably positioned on said carrier support surface.

6. A die assembly according to claim 5 wherein:

(G) said die assembly further includes open cell compressible members supported on said base member adjacent said rule for supporting the stacked material layers substantially on said sharpened upper edge; and (H) said die assembly vacuum surface is defined along a peripheral edge portion of said open cell compressible members.

7. A die assembly according to claim 6 wherein:

(I) said die carrier includes;

(1) a base plate defining said support surface at its upper face and (2) a fence member extending along and upstanding from at least one edge of said base plate and defining said die carrier vacuum surface at its inboard surface.

8. A die assembly according to claim 7 wherein:

(J) said fence member comprises an imperforate fence portion upstanding from and extending along said at least one edge of said base plate and a perforate portion positioned along and inboard of said imperforate fence portion and spaced inboard from said imperforate fence portion to define with said imperforate fence portion a vacuum channel;

(K) said vacuum surface on the peripheral edge portion of said compressible members is sized and configured to fit snugly against and along the inboard face of said perforate portion with said die positioned on said base plate; and (I) said exhaust means includes port means extending through said imperforate fence portion to communicate said vacuum channel with vacuum pump means.

9. A die assembly according to claim 8 wherein:

(M) said base plate is generally rectangular; and (N) said fence portion extends around and along at least two adjacent peripheral edges of said base plate to define a continuous vacuum chamber along said adjacent peripheral edges; and (O) said compressible members define two adjacent vacuum surfaces along adjacent peripheral edge surfaces of said compressible members adapted to fit snuggly against the respective perforate portions of said fence member.

10. A die assembly according to claim 8 wherein:

(M) said fence member comprises a tubular structure of rectangular cross section;

(N) said perforate portion of said fence member is constituted by the inner wall of said tubular structure; and (O) said imperforate portion of said fence member is constituted by the outer wall of said tubular structure.

11. A die assembly, according to claim 10 wherein:

(P) said base plate is rectangular with long side edges and short end edges;

(Q) said tubular members extends in a closed loop around all four edges of said base plate;

(R) said die assembly further included a conduit communicating at one end with an opening in the imperforate outer wall of said tubular structure along an end edge of said base plate and adapted for connection at its other end with a vacuum hose.

12. A die assembly according to claim 11 wherein said die assembly further includes:

(S) a check valve in said conduit arranged to close in response to disconnection of the vacuum hose from said conduit to maintain the vacuum condition is said vacuum chamber.

13. A steel rule die assembly for cutting a fixed pattern in each of a plurality of stacked compressible material layers according to the shape of the steel rule, said die assembly comprising:

(A) a die carrier having side walls and a bottom wall defining an open top die chamber;

(B) a steel rule die including (1) a base member adapted to be removably positioned on said bottom wall and having a size and shape to fit snuggly in said die chamber, (2) a steel rule fixedly upstanding from said base member in spaced relation to said die carrier side walls and having an exposed sharpened upper edge defining the fixed cutting pattern, and (3) open cell compressible material interposed between said steel rule and said die carrier side walls;

(C) air-impervious cover means for covering said die carrier and said die and any layers of compressible material overlying said sharpened upper cutting edge to define a vacuum chamber; and (D) means associated with said die carrier, including means creating a vacuum condition along said die carrier side walls, operative to suck air out of said stacked layers of compressible materials and downwardly outwardly through said side walls to compress and reduced the thickness of said stacked layers to facilitate the cutting operation.

14. A steel rule assembly according to claim 13 wherein:

(E) said vacuum condition creating means comprises (1) perforated elongated members positioned respectively along and inboard of said die carrier side walls to form a continuous vacuum channel along said side walls, and (2) means communicating said channel with vacuum pump means.

15. A steel rule assembly according to claim 13 and further including:

(E) a rigid board having a horizontal extent at least as great as the horizontal extent of said stacked layers, placed over said stacked layers and under said cover means and operative to preclude horizontal compression of said stacked layers as said stacked layers are vertically compressed in response to evacuation of said chamber.

16. A stationary steel rule die apparatus for cutting a fixed pattern in each of a plurality of stacked compressible material layers according to the shape of said rule comprising:

(A) a base;

(B) a steel rule having an exposed sharpened edge and being fixed to the base for defining the fixed cutting pattern;

(C) air-impervious cover means for covering said base and any layers of compressible material overlying said edge to define a vacuum chamber;

(D) means for evacuating said vacuum chamber to compress and reduce the thickness of said stacked layers before cutting same with said rule and including conduit means in communication at one end thereof with said vacuum chamber and adapted to be connected at the other end thereof to a source of vacuum; and (E) means operative in response to disconnection of said conduit means from said source of vacuum to maintain the vacuum condition in said chamber.

17. A steel rule die according to claim 16 wherein:

(G) said operative means comprises a check valve in said conduit means.

18. A steel rule die according to claim 17 wherein:

(H) said other end of said conduit means is connected to said source of vacuum by a vacuum hose extending between the vacuum source and said other end of said conduit means; and (I) said check valve is arranged to close in response to disconnection of said vacuum hose from the other end of said conduit means to maintain the vacuum condition in said vacuum chamber.

19. A steel rule assembly according to claim 16 wherein:

(J) said vacuum condition maintaining means includes;

(1) a conduit communicating at one end with said volume and adapted to be connected at its other end with a vacuum hose, and (2) a check valve in said conduit operative upon removal of the vacuum hose to maintain said vacuum condition.

* * * * *

UNITED STATES PATENT AND TRADEMARK OFFICE

CERTIFICATE OF CORRECTION

PATENT NO. : 4,672,870
DATED : June 16, 1987
INVENTOR(S) : Martin M. Levene and William W. Lessard It is certified that error appears in the above-identified patent and that said Letters Patent is hereby corrected as shown below:

Title page,
Item [*] Notice, "The portion of the term of this patent subsequent to Oct. 1, 2002 has been disclaimed." has been replaced with -- This patent is subject to a terminal disclaimer. --

Signed and Sealed this

Tenth Day of February, 2004

JON W. DUDAS
*Acting Director of the United States Patent and Trademark Office*